US010137704B2

(12) United States Patent
Faundez et al.

(10) Patent No.: US 10,137,704 B2
(45) **Date of Patent: *Nov. 27, 2018**

(54) EDGE HOLDERS

(71) Applicant: Hewlett-Packard Development Company, L.P., Houston, TX (US)

(72) Inventors: David Faundez, Sant Cugat del Valles (ES); Marcos Arminana, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,851

(22) Filed: Jul. 15, 2017

(65) Prior Publication Data

US 2018/0126755 A1 May 10, 2018

Related U.S. Application Data

(63) Continuation of application No. 15/195,585, filed on Jun. 28, 2016, now Pat. No. 9,707,777.

(51) Int. Cl.
*B41J 11/00* (2006.01)
*B41J 13/08* (2006.01)

(52) U.S. Cl.
CPC ..... *B41J 11/0045* (2013.01); *B41J 11/005* (2013.01); *B41J 11/007* (2013.01); *B41J 13/08* (2013.01)

(58) Field of Classification Search
CPC ... B41J 11/005; B41J 11/0025; B41J 11/0045; B41J 11/0055; B41J 15/046
See application file for complete search history.

(56) References Cited

U.S. PATENT DOCUMENTS 5,354,139 A * 10/1994 Barrus ..... B41J 11/30 226/74
7,312,807 B2 12/2007 Comas et al.
7,437,119 B2 10/2008 Takemoto et al.
8,870,330 B1 10/2014 Borrell Avila et al.
9,028,160 B2 * 5/2015 Garcia ..... B41J 11/0025 101/474

FOREIGN PATENT DOCUMENTS

JP 2002249242 9/2002

OTHER PUBLICATIONS

HP, Media Loading Accessories, HP DesignJet L26500/L28500 Edge Holder (B8K59A) <http://www8.hp.com/emea_africa/en/products/oas/product-detail.html?oid=5326899>.

* cited by examiner

*Primary Examiner* — Juanita D Jackson
(74) *Attorney, Agent, or Firm* — HP Inc. Patent Department

(57) ABSTRACT

In an example, an edge holder may include a strap, a first end cap fixed to the strap, and a second end cap fixed to an opposite end of the strap from the first end cap. The second end cap may include a fixed end and a cam engaged with the fixed end. The cam may adjustably tension the strap between the first end cap and the second end cap.

15 Claims, 5 Drawing Sheets

EDGE HOLDERS

BACKGROUND

Imaging systems may print, scan, copy, or perform other actions or operations with media. The imaging systems may scan the media for markings or patterns, deposit printing fluid, such as ink or another printing substance, on the media, and/or may produce duplicates of the media, including markings or patterns thereon, in addition to other functions. Further, imaging systems may include feeding systems to load the media and drive the media through the imaging system. The feeding system may drive media through an operation zone of the imaging device, wherein the imaging device may perform operations on or with the media.

DETAILED DESCRIPTION

Figure 1:
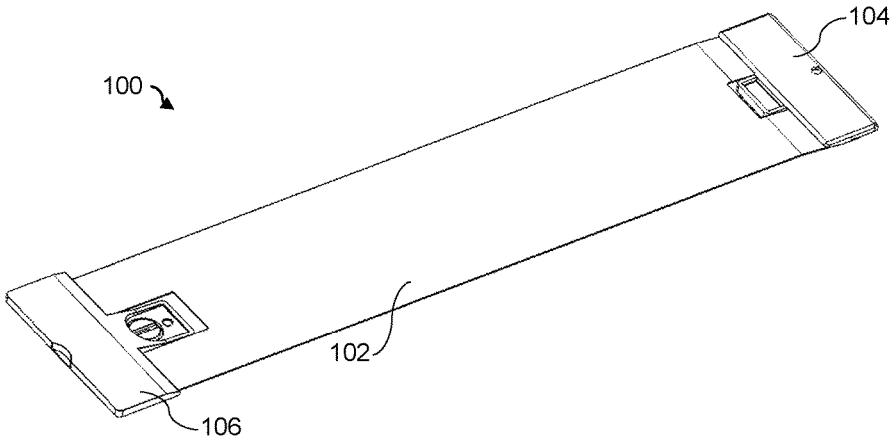
FIG. 1 is a perspective view of an example edge holder.

Imaging systems may print, scan, copy, or perform other actions or operations with media. The imaging systems may scan the media for markings or patterns, deposit printing fluid, such as ink or another printing substance, on the media, and/or may produce duplicates of the media, including markings or patterns thereon, in addition to other functions. Further, imaging systems may include feeding or picking systems to load the media and deliver or drive the media through the imaging system. The feeding system may deliver media through an operation zone of the imaging device, wherein the imaging device may perform operations on or with the media.

The feeding system may deliver the media over an operation surface, sometimes referred to as a platen, within the operation zone, whereupon the media is disposed as the imaging device performs an operation on the media. In some situations, a substance or method used in the imaging device operation may have detrimental effects on the media within the operation zone. For example, in some situations, ink used or heat applied to the ink and/or media may cause the media to roll, buckle, or otherwise deform within the operation zone. Such deformed media may result in errors or poor quality in the imaging device operation. Further, such deformed media may elevate or raise above the operation surface enough to interfere with other components of the imaging device, for example, a printhead carriage.

In some situations, it may be desirable for the media to be retained to, or held within a threshold distance of, the operation surface while the media is delivered through the operation zone, and/or while the imaging system performs an action on the media. The threshold distance may be a sufficient distance to the operation surface for an imaging operation to be performed on or with the media. For example, in some situations, a vacuum or negative pressure may be applied to the underside of the media as it travels over the operation surface, in order to retain the media to the surface. Such retention of the media may, for example, avoid deformation of the media within the operation zone, and, thus, may avoid errors and/or poor quality in the imaging operation. In some situations, the method of retaining the media to the operation surface may be less effective on the edges of the media, for example. As such, some portions of the media may be adequately retained to the operation surface, yet other portions, such as the edges of the media, may still be able to deform and elevate above the operation surface during the imaging operation, resulting in, for example, poor quality and/or errors in the imaging operation.

In some situations, it may be desirable to include a supplementary device to retain portions of the media to the operation surface. For example, it may be desirable to implement a device in the imaging device that retains an edge of the media to the operation surface, thus avoiding deformation of such an edge of the media and poor quality and/or errors in the imaging operation.

Implementations of the present disclosure provide an edge holder to retain a portion of media to an operation surface of an imaging device. The edge holder may retain the media to the operation surface so as to avoid deformation of the media, and thus, errors or poor quality in the imaging operation performed by the imaging device on or with the media. Further, the edge holder may be removable. When installed in the imaging device, the edge holder may be disposed on the operation surface such that the media may travel along the operation surface in between the surface and the edge holder. Further, the edge holder may be disposed close enough to the operation surface such that the edge holder does not interfere with other components of the imaging device. Additionally, if the edge holder, or a portion thereof, were to impact another component of the imaging device, the edge holder, in some situations, may act as a fuse and strategically break or fail so as to avoid damaging the other components of the imaging device.

Referring now to FIG. 1, a perspective view of an example edge holder 100 is illustrated. The edge holder 100 may include a strap 102, a first end cap 104 fixed to a first end of the strap 102, and a second end cap 106 fixed to a second end of the strap 102, opposite from the first end. The strap 102 may be a film, strip, belt, or layer extending between the first and second end caps 104 and 106. Further, the strap 102 may be tensioned between the first and second end caps 104 and 106 such that it lays flat against a surface to which the edge holder 100 is attached or engaged. In some implementations, the strap 102 may be formed of a polymer material, such as polycarbonate or another thermoplastic, for example. In other implementations, the strap 102 may be formed of another material, such as a metal or rubber material. In further implementations, the strap 102 may be partially or wholly formed of a material that may break, tear, or otherwise destruct across the width of the strap 102, when impacted by another component. In some implementations, the strap 102 may break when impacted by a printhead carriage of the imaging device so as to avoid damage to the printhead carriage.

The first and second end caps 104 and 106 may be rigid or semi-rigid components and may be removably attached to or disposed on opposite ends of the strap 102. In some implementations, each of the first and second end caps 104 and 106 may engage with an edge, end, or lip of a surface upon which the edge holder is installed, and the strap 102 may extend between the end caps to span the surface. In some implementations, each of the first and second end caps 104 and 106 may engage with a first and second end or edge of an operation surface of an imaging device, such that the strap 102 extends across the operation surface, and is tensioned between the first and second end caps 104 and 106 across the operation surface. In other words, the first end cap 104 may retain the first end of the strap 102 to the operation surface, and the second end cap 106 may retain the second end of the strap to the operation surface.

Figure 2A:
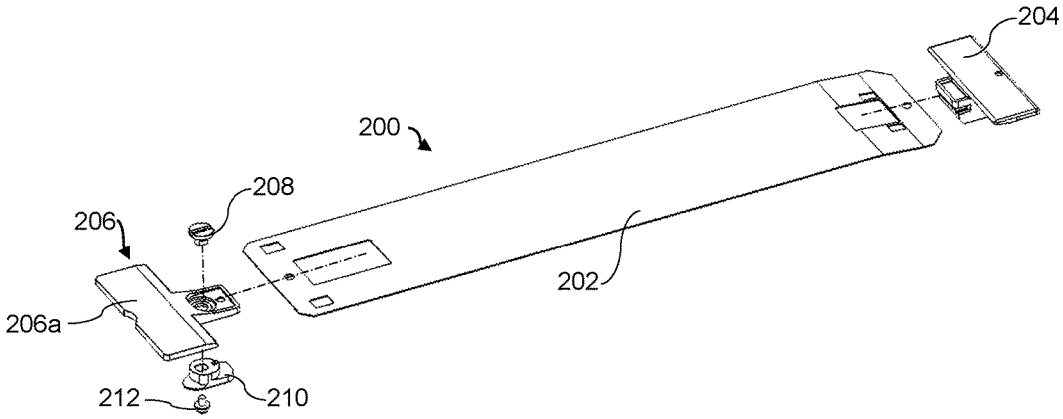
FIG. 2A is a perspective exploded view of an example edge holder.

Referring now to FIG. 2A, a perspective exploded view of an example edge holder 200 is illustrated. Example edge holder 200 may be similar to example edge holder 100. Further, the similarly named elements of example edge holder 200 may be similar in function and/or structure to the elements of example edge holder 100, as they are described above. The edge holder 200 may include a strap 202, a first end cap 204, and a second end cap 206. In some implementations, the second end cap 206 may include a fixed end 206*a* to attach to the strap 202 and a cam 210 engaged with, attached to, or fixed to the fixed end 206*a*. In some implementations, the cam 210 may be rotatably engaged with the second end cap 206, or the fixed end 206*a* thereof. In further implementations, the second end cap 206 may further include a cam fastener 208 to engage with the cam 210 and the fixed end 206*a*, and a retention fastener 212 to engage with the cam fastener 208 and the cam 210 such that the retention fastener 212 and the cam fastener 208 retain the cam 210 to the fixed end 206*a*.

Figure 2B:
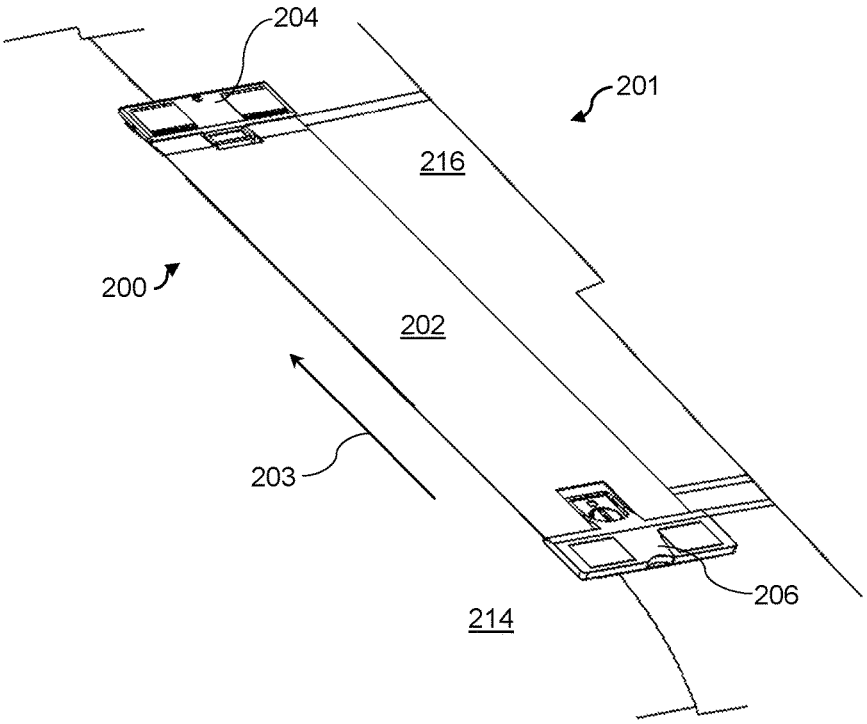
FIG. 2B is a perspective view of an example edge holder.

Referring now to FIG. 2B, a perspective view of an example edge holder 200 is illustrated, wherein the edge holder 200 is assembled onto, or engaged with, an imaging device 201. In some implementations, the imaging device 201 may be a printer, plotter, copier, scanner, printing press, or another imaging device to perform actions or operations on or with media 214. In further implementations, the media 214 may be print media, and may further be paper, latex, vinyl, or another print media suitable for use in an imaging device. In some implementations, the imaging device 201 may include an operation surface 216 to receive media 214, or over which the media 214 may be delivered or driven. The operation surface 216 may be a surface disposed in an operation zone of the imaging device. In further implementations, the imaging device 201 may perform actions on or with the media 214 while the media 214 is disposed in, or travels over or through the operation surface 216. For example, in some implementations, the media 214 may be delivered over the operation surface 216 in a direction 203 as the imaging device 201 performs an action, such as printing, on the media 214. In some implementations, the operation zone may be referred to as a print zone, and the operation surface 216 may be referred to as a platen, or a print platen. In further implementations, the platen 216 may be disposed in a print zone of a printer 201, and another imaging device component, such as a carriage, or printhead carriage, for example, may be disposed directly above the platen 216, or may move over the platen 216 in order to print on the media 214.

The example edge holder 200 may engage with the operation surface 216 of the imaging device 201, in some implementations, and may retain media 214 to, or hold media against, the operation surface 216 when the media travels over or through the operation surface 216, or is otherwise disposed in the operation zone. In further implementations, the media 214 may be delivered over the operation surface and underneath the edge holder 200, or the strap 202 thereof, as illustrated in FIG. 2B, such that the media 214 cannot elevate up from the operation surface 216 far enough to be deformed by an imaging operation, or far enough to cause an error or poor quality in the imaging operation. In yet further implementations, the first end cap 204 and the second end cap 206 may engage with a first end and a second end of the operation surface 216, respectively, such that the strap is held flat against the operation surface 216, and the media 214 may travel between the operation surface 216 and the strap 202.

Figure 2C:
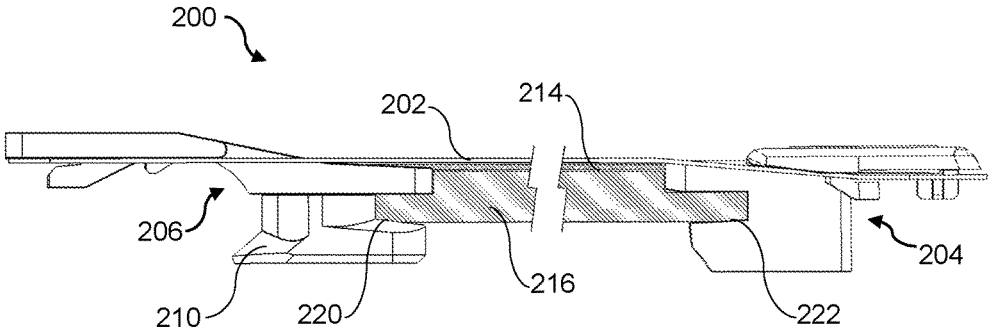
FIG. 2C is a side cross-sectional view of an example edge holder.

Referring additionally to FIG. 2C, a side cross-sectional view of the example edge holder 200 is illustrated, wherein the edge holder 200 is affixed to or engaged with the operation surface 216. In some implementations, the first end cap 204 may include a notch 222 to engage with a first end of the operation surface 216. Additionally, the second end cap 206 may include a cam notch 220 to engage with a second end of the operation surface 216. The cam 210 may be engaged with the second end cap 206 to define the cam notch 220. In other words, the cam 210 may engage the second end cap 206 with the operation surface 216. Further, the cam notch 220 may adjustably engage with the second end of the operation surface 216, such that the cam 206 may adjustably tension the strap 202 between the first end cap 204 and the second end cap 206. The cam 210 may adjustably tension the strap 202 such that the media 214 may be held against the operation surface 216 by the strap 202. In some implementations, neither the first end cap 204, nor the second end cap 206 may extend up from the operation surface 216 to a degree sufficient to interfere with another component, such as a printhead carriage, of the imaging device 201. In other words, the edge holder 200 may fit in between the operation surface 216 and a printhead carriage of the imaging device 201. Therefore, during operation, the printhead carriage, or another component, may not strike or impact the edge holder 200, or an element thereof, in some implementations.

Figure 3A:
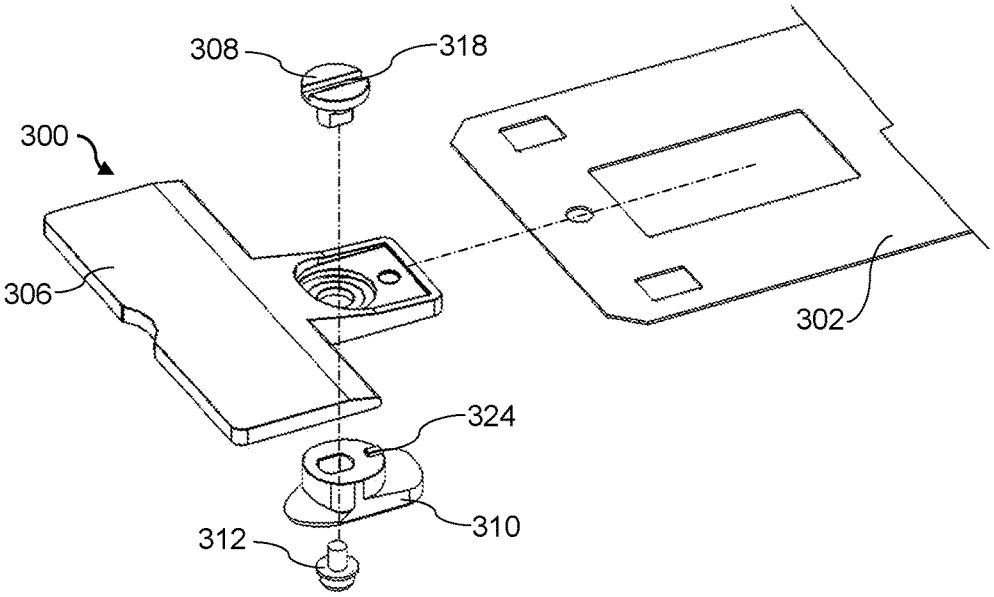
FIG. 3A is a perspective exploded view of an example edge holder.

Referring now to FIG. 3A, a perspective exploded view of an example edge holder 300 is illustrated. Example edge holder 300 may be similar to above-described example edge holders. Further, the similarly named elements of example edge holder 300 may be similar in function and/or structure to the elements of other example edge holders, as they are described above. Edge holder 300 may include a strap 302 and a second end cap 306. The edge holder 300 may also include a cam 310 rotatably engaged with the second end cap 306, or a fixed end thereof. The cam 310 may rotate to adjust a cam notch to adjustably tension the strap 302, in some implementations. In further implementations, the cam 310 may be assembled on to the second end cap 306 by a cam fastener 308. The cam fastener 308, when assembled to the cam 310 and the second end cap 306, may be fixed relative to the cam, such that the cam may rotate relative to the second end cap 306 when the cam fastener 308 rotates relative to the end cap 306. In further implementations, the cam fastener 308 may engage with the cam 310 through a pin and slot engagement, wherein the pin and slot have complementary flat sides, as illustrated in FIG. 3A. In further implementations, such an engagement may be referred to as a D-flat engagement. The cam fastener 308 may sometimes include an actuation slot 318. The actuation slot 318, in some implementations, may be sized and/or structured sufficiently to receive a device to rotate the cam fastener 308. The device may be any element that may fit in the actuation slot 318 tightly enough to rotate the cam fastener 308. Such rotation may, in turn, rotate the cam 310 relative to the second end cap 306, or a fixed end thereof, to adjust the tension in the strap 302. In further implementations, the cam 310 may include the actuation slot 318, and the device may rotate the cam 310 directly. In some implementations, the cam 310 may be assembled to the cam fastener 308 using a retention fastener 312, such as a screw, bolt, pin, or other fastener.

Figure 3B:
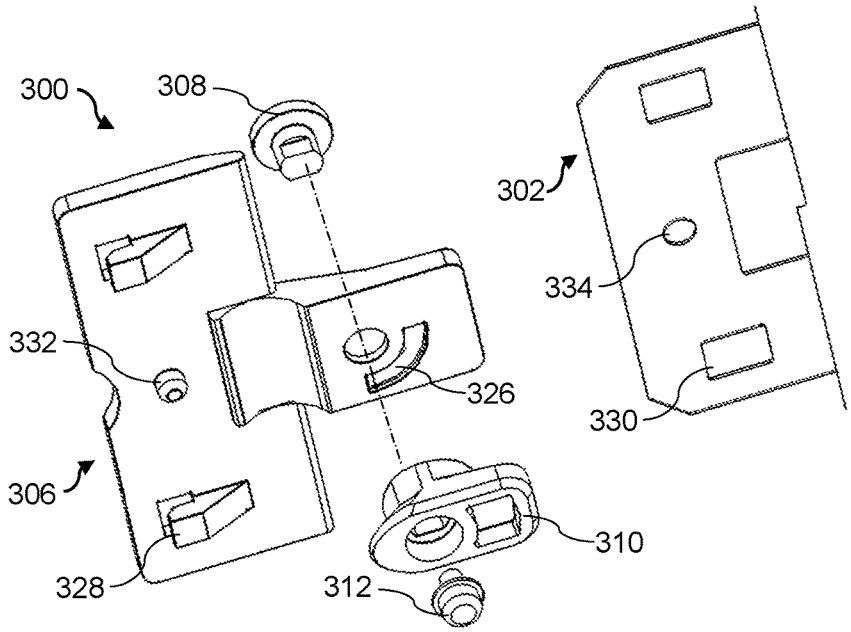
FIG. 3B is a perspective exploded view of an example edge holder.

Referring additionally to FIG. 3B, an underside perspective exploded view of the example edge holder 300 is illustrated. In some implementations, the cam 310 may include a key 324 that may engage with a keyway 326 on the second end cap 306. The engagement between the key 324 and the keyway 326 may limit the amount of relative movement that may exist in between the cam 310 and the second end cap 306. In some implementations, the key 324 and the keyway 326 may limit the rotatable nature of the cam 310, such that it is restricted to rotate relative to the second end cap a desired amount, or through a desired angle of rotation. In some implementations, the key 324 may be disposed on the second end cap 306, and the corresponding keyway 326 may be disposed on the cam 310. In further implementations, the movement between the cam 310 and the second end cap 306 may be limited by another element or engagement feature.

In some implementations, the strap 302 may be removable from the second end cap 306, as well as from a first end cap disposed on an opposite end of the strap 302. Note, although only the second end cap 306 may be illustrated in FIGS. 3A-B, the first end cap may include similar features to those of the second end cap 306. The strap 302 may include a first end to removably engage with the first end cap, and a second end, shown in FIGS. 3A-B, to engage with the second end cap 306. Each of the first and second ends of the strap 302 may include a holding notch 330. In some implementations, one or both of the first and second ends of the strap 302 may include multiple holding notches 330. Correspondingly, each of the first and second end caps of the edge holder 300 may include a holding feature 328 to engage with a holding notch 330 on the respective end of the strap 302. Each holding feature 328 may be a hook, latch, or other protrusion that may be sized and structured sufficiently to engage with the respective holding notch 330 such that the holding features 328 restrain the strap 302 towards the first and second end caps. Additionally, each of the holding notches 330 may be an aperture, opening, window, or other cutout to engage with the respective holding feature 328.

In further implementations, each of the first and second end caps may include a restraint pin 332 to engage with a restraint notch 334 on the respective end of the strap 302. The restraint notch 334 may be an opening or aperture in the strap 302 to receive the restraint pin 332, such that the engagement between the restraint pin 332 and the restraint notch 334 may maintain the engagement between the holding features 328 and the holding notches 330 on the respective end of the strap 302. In some implementations, the engagement of the restrain pin 332 and restraint notch 334, and the engagement between the holding features 328 and holding notches 330 may complement each other such that the strap 302 is held securely to each of the first and second end caps when the edge holder 300 is engaged with an operation surface of an imaging device. In further implementations, the strap 302 may be removable from one or both of the first and second end caps when the edge holder 300 is disengaged from the operation surface of the imaging device. The strap 302 may be manipulated and/or bent or deformed in order to disengage the holding features 328 from the holding notches 330, and the restraint pin 332 from the restraint notch 334. In some implementations, the strap 302 may be replaced with another strap 302 if, for example, the strap 302 has broken from impact or contact with another component of the imaging device, such as a printhead carriage.

Figure 3C:
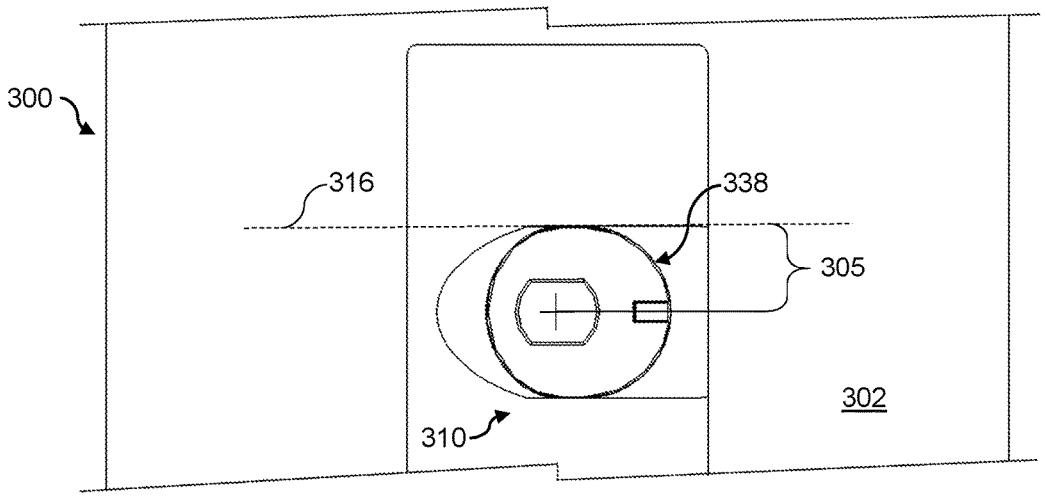
FIG. 3C is a top view of an example edge holder.
Figure 3D:
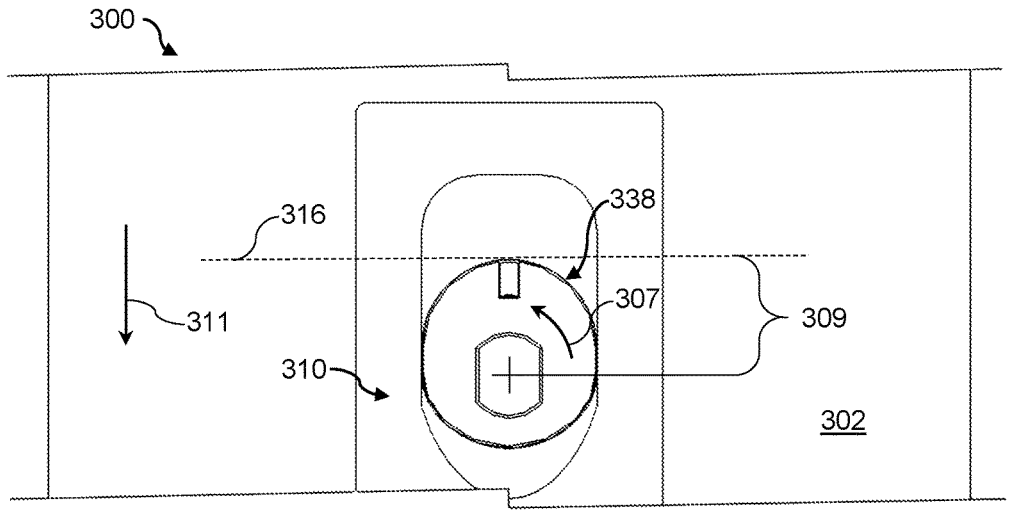
FIG. 3D is a top view of an example edge holder.

Referring now to FIGS. 3C-D, top views of the example edge holder 300 are illustrated, wherein the cam 310 is disposed in two different positions to adjustably tension the strap 302. In the illustrated examples, the edge holder 300 may be installed on the operation surface of the imaging device, and the second end of the operation surface may be represented by line 316. Upon first installing the edge holder 300 to the operation surface, the cam 310 may be disposed in a loosened position, as illustrated FIG. 3C. The distance between a center of rotation of the cam 310 and the second end of the operation surface 316 may be represented by distance 305 in such a situation. The cam 310 may have a curved surface 338 that may define a cam notch to engage with the second end 316. The curved surface 338 may be eccentric to the center of rotation of the cam 310. Therefore, upon the cam being tightened to a tightened position, for example, by being rotated along direction 307 relative to the operation surface, or the second end 316 thereof, as illustrated in FIG. 3D, the distance between the center of rotation of the cam and the second end of the operation surface 316 may now be represented by distance 309. Distance 309 may be larger than distance 305, and thus, in the tightened position, the cam 310 may exert a higher tension on the strap 302, thereby tightening the strap 302 along direction 311. Although in FIGS. 3C-D the second end cap 306 may be hidden for clarity, upon being rotated to the tightened position, the cam 310 may push on second end cap 306 along direction 311. Second end cap 306 may, thus, pull on the strap 302 through the engagement of the restraint pin and restraint notch, and the engagement of the holding features and the holding notches.

Figure 4:
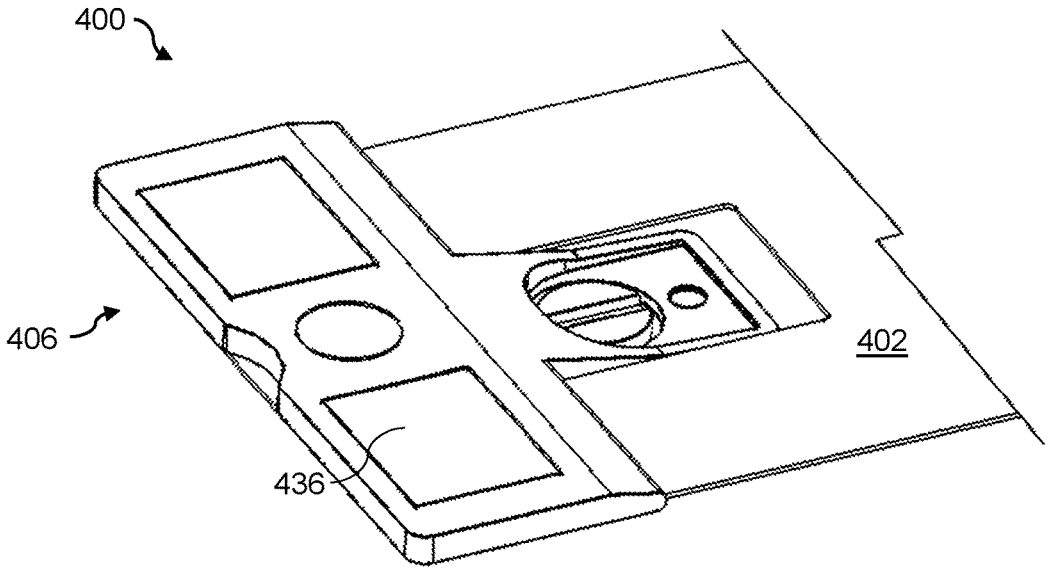
FIG. 4 is a perspective view of an example edge holder.

Referring now to FIG. 4, a perspective view of an example edge holder 400 is illustrated. Example edge holder 400 may be similar to above-described example edge holders. Further, the similarly named elements of example edge holder 400 may be similar in function and/or structure to the elements of other example edge holders, as they are described above. Edge holder 400, in some implementations, may include a strap 402 and stowage elements 436. In further implementations, the stowage elements 436 may be disposed on a first end cap, a second end cap 406, or both, of the edge holder 400. The stowage elements 436 may be components that may engage with other components of an imaging device in order to stow the edge holder 400 when the edge holder 400 is not installed in the imaging device. In some implementations, the stowage elements 436 may be magnets, or comprise a magnetic material such that the edge holder 400 may hang from a portion of the imaging device. For example, the stowage elements 436 may magnetically hang on a metallic panel or surface of the imaging device to stow the edge holder 400 when the edge holder 400 is not installed in the imaging device.

What is claimed is:

1. An edge holder, comprising:

a strap;

a first end cap attached to a first end of the strap;

a second end cap attached to a second end of the strap, opposite the first end; and a cam rotatably engaged with the second end cap to adjustably tension the strap between the first end cap and the second end cap.

2. The edge holder of claim 1, wherein the cam is to rotate about an axis normal to a plane of the strap to adjustably tension the strap along a longitudinal direction of the strap.

3. The edge holder of claim 1, wherein the second end cap comprises a cam notch to engage an operation surface.

4. The edge holder of claim 3, wherein the cam notch is defined by the cam.

5. The edge holder of claim 4, wherein the cam is to rotate to adjust the cam notch to adjustably tension the strap.

6. The edge holder of claim 1, wherein the first end cap and the second end cap are to engage an operation surface such that the strap is held flat against the operation surface to retain media to the operation surface.

7. An edge holder to engage with an operation surface, comprising:

a strap to retain media to the operation surface;

a first end cap attached to an end of the strap and to engage with a first end of the operation surface;

a second end cap attached to an opposite end of the strap from the first end cap, the second end cap to engage with a second end of the operation surface; and a cam rotatably engaged with the second end cap to adjustably tension the strap between the first end cap and the second end cap against the operation surface.

8. The edge holder of claim 7, the cam defining a cam notch to engage with the second end of the operation surface to adjustably tension the strap.

9. The edge holder of claim 7, wherein the first and second ends of the strap each comprise a restraint notch to receive a restraint pin, and a holding notch to receive a holding feature to attach the strap to the first end cap and the second end cap.

10. The edge holder of claim 7, wherein the cam is to rotate about an axis perpendicular to a plane of the strap to adjustably tension the strap along the plane of the strap.

11. The edge holder of claim 7, wherein the operation surface is a print platen of a printer and the media is print media.

12. An imaging device, comprising:

a print platen to receive print media; and an edge holder to be removably attached to the print platen, comprising:

a strap to retain the print media to the print platen;

a first end cap attached to a first end of the strap to retain the first end of the strap to the print platen;

a second end cap attached to a second end of the strap opposite from the first end cap; and a cam engaging the second end cap with the print platen, the cam rotatably engaged with the second end cap to adjustably tension the strap against the print platen, wherein the print media is to be conveyed between the print platen and the strap.

13. The imaging device of claim 12, wherein the cam is to rotate relative to the print platen about an axis normal to a plane of the strap to adjust the tension of the strap along a longitudinal direction of the strap.

14. The imaging device of claim 12, wherein the second end cap includes a cam fastener to retain the cam to a fixed end of the second end cap.

15. The imaging device of claim 14, wherein the cam is assembled to the cam fastener using a retention fastener.

* * * * *